US006939246B1

(12) United States Patent
Minichino et al.

(10) Patent No.: US 6,939,246 B1
(45) Date of Patent: Sep. 6, 2005

(54) GOLF SWING TRAINING APPARATUS

(75) Inventors: Michael A. Minichino, New Port Richey, FL (US); Thomas P. Cappadona, New Port Richey, FL (US)

(73) Assignee: Genesis Creations Corp., New Port Richey, FL (US)

( * ) Notice: Subject to any disclaimer, the term of this patent is extended or adjusted under 35 U.S.C. 154(b) by 0 days.

(21) Appl. No.: 10/939,212

(22) Filed: Sep. 10, 2004

(51) Int. Cl.[7] ..... A63B 69/36
(52) U.S. Cl. ..... 473/274; 473/208
(58) Field of Search ..... 473/206, 207, 473/208, 212, 215, 216, 274, 422

(56) References Cited

U.S. PATENT DOCUMENTS 3,677,551 A * 7/1972 Schaus ..... 473/208
5,149,099 A * 9/1992 Radakovich ..... 473/208
5,704,856 A * 1/1998 Morse ..... 473/422
5,893,803 A * 4/1999 Leadbetter et al. ..... 473/206
6,620,052 B2 * 9/2003 Piatt ..... 473/208

* cited by examiner

*Primary Examiner*—Gregory Vidovich
*Assistant Examiner*—Nini F. Legesse
(74) *Attorney, Agent, or Firm*—Larson & Larson, PA; Herbert W. Larson

(57) ABSTRACT

A top loop fits around the neck of a golfer. A bottom loop fits around the mid-section of the golfer. An intermediate section containing a breakaway unit connects the top loop to the bottom loop. If the golfer projects an acceptable swing, the breakaway unit does not disengage until the golfer reaches the follow through mode. If the breakaway unit disengages during the downward or ball contact mode, then the swing has not been satisfactory.

20 Claims, 4 Drawing Sheets

GOLF SWING TRAINING APPARATUS

FIELD OF THE INVENTION

The present invention relates to a training apparatus for a golfer's controlled swing. More specifically, it refers to a golf swing training device looped around the neck and attached to the mid-section of a golfer to accentuate a bad swing.

BACKGROUND OF THE INVENTION

Golf has become one of the most watched and played sports in the United States. It is unique in that good play depends primarily on a controlled swing of a golf club by the golfer. Lifting one's head is a common mistake which usually results in an errant shot. A device is needed which will immediately alert the golfer during practice that his or her swing is defective.

SUMMARY OF THE INVENTION

The present invention solves the golfer's need for a controlled swing by providing an inexpensive golf swing training apparatus. The training apparatus has a top loop which fits around the neck of the golfer and a bottom loop surrounding the front portion of the golfer's belt or other device at the golfer's mid-section. A breakaway portion between the two loops disengages during the golfer's swing. If the disengagement occurs at the end of the swing, then the golfer has made a proper swing. However, if the breakaway portion disengages during the downswing or on contact with the golf ball, then the swing is defective, and in all likelihood, the golf ball will not follow a straight path.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
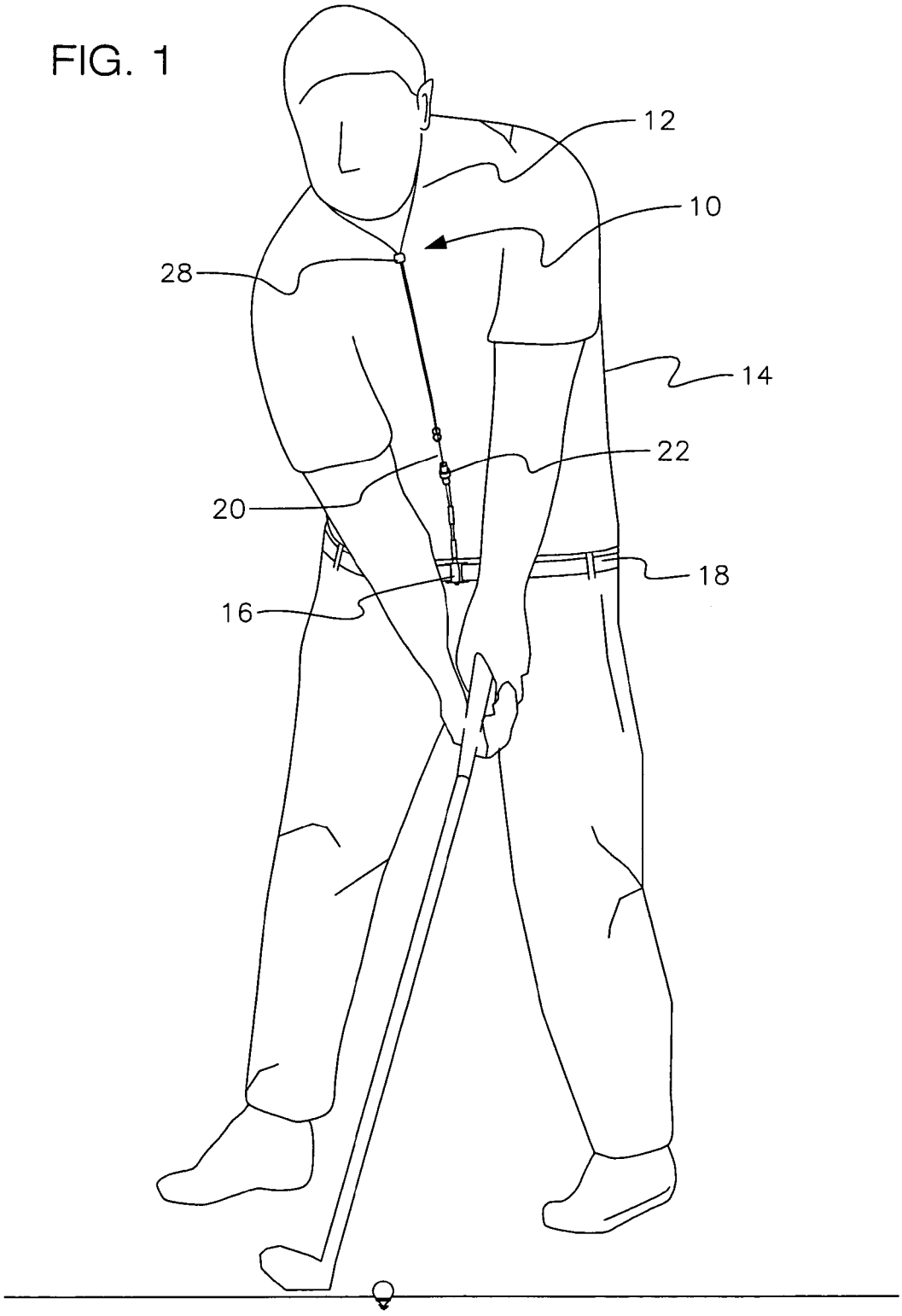
FIG. 1 is a front elevational view of a golfer addressing a golf ball with the training aid of this invention in place.

Throughout the following detailed description the same reference numerals refer to the same elements in all figures.

Referring to FIG. 1, the training aid apparatus 10 has three main parts. An upper loop 12 fits around the neck of a golfer 14. One of a lower group of multiple loops 16 fit around the golfer's belt 18. The exact loop 16 employed depends on the torso size of the golfer. An intermediate portion 20 which connects the upper loop 12 to the lower loops 16 contains a breakaway section 22.

Figure 2:
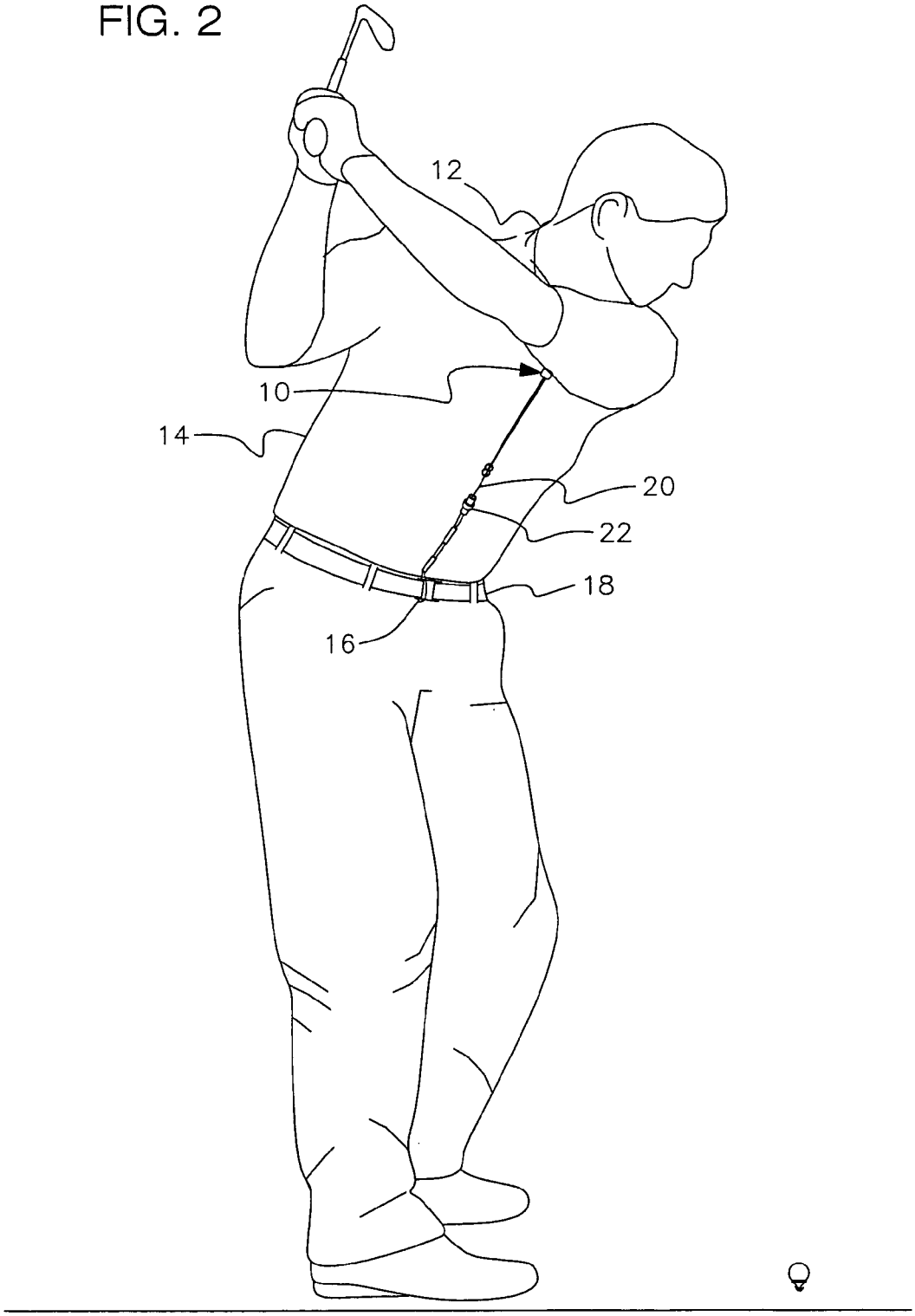
FIG. 2 is a front elevational view of a golfer in his proper back swing with the training aid engaged.
Figure 3:
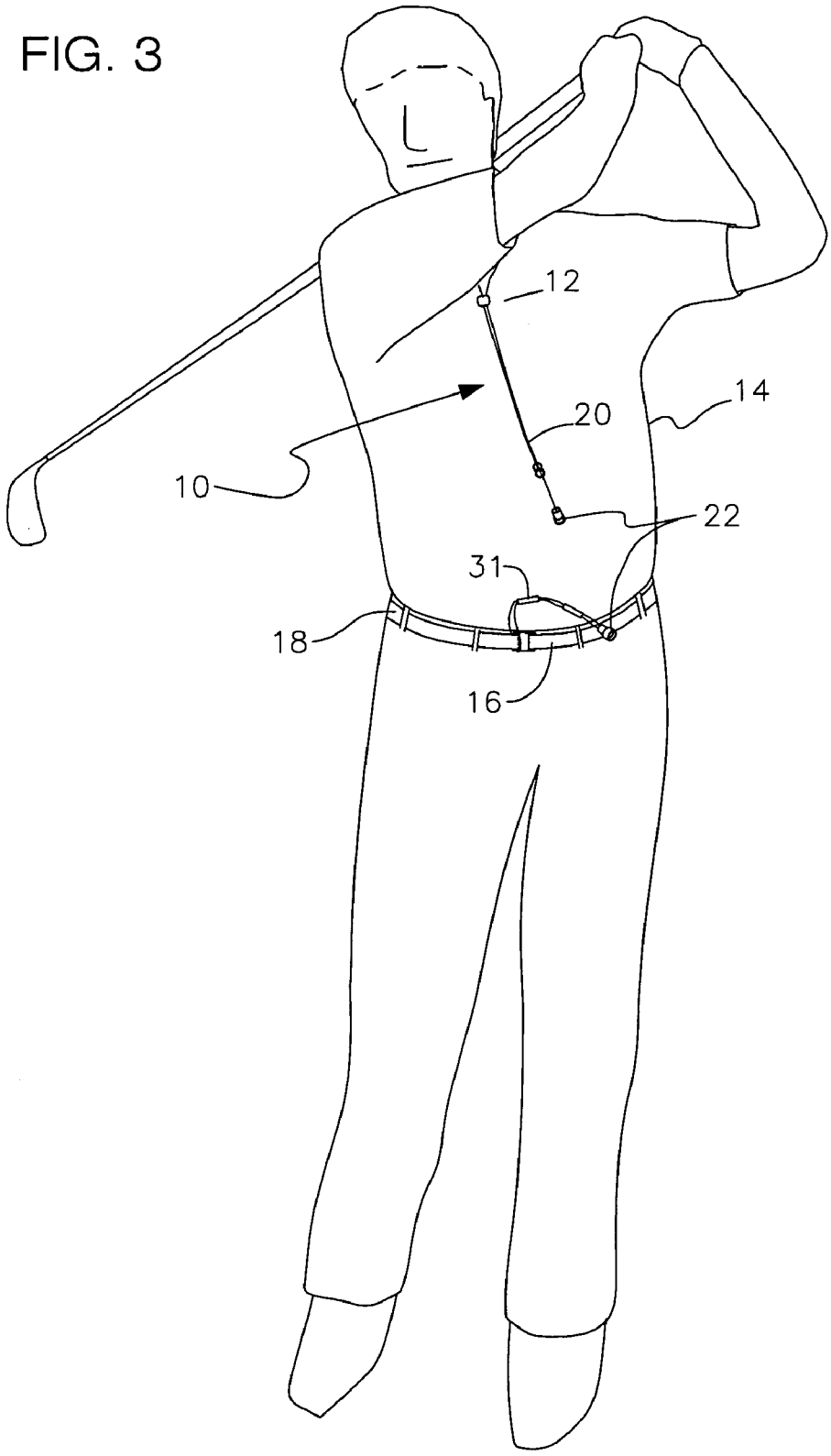
FIG. 3 is a front elevational view of a golfer in his follow through mode showing the training aid disengaged.

As seen in FIGS. 1 and 2, the combined upper loop 12, intermediate portion 20, and lower loops 16 provide a straight profile under slight tension between the neck and belt of the golfer. As the golfer 14 begins his backswing, as shown in FIG. 2, the breakaway section 22 remains engaged, providing the golfer is projecting a proper swing. Not until the golfer reaches his follow through swing mode, as shown in FIG. 3, does the breakaway element 22 disengage, provided the swing is properly carried out. If the breakaway section 22 disengages before the follow through swing mode, then the swing has been defective and needs further work.

Figure 4:
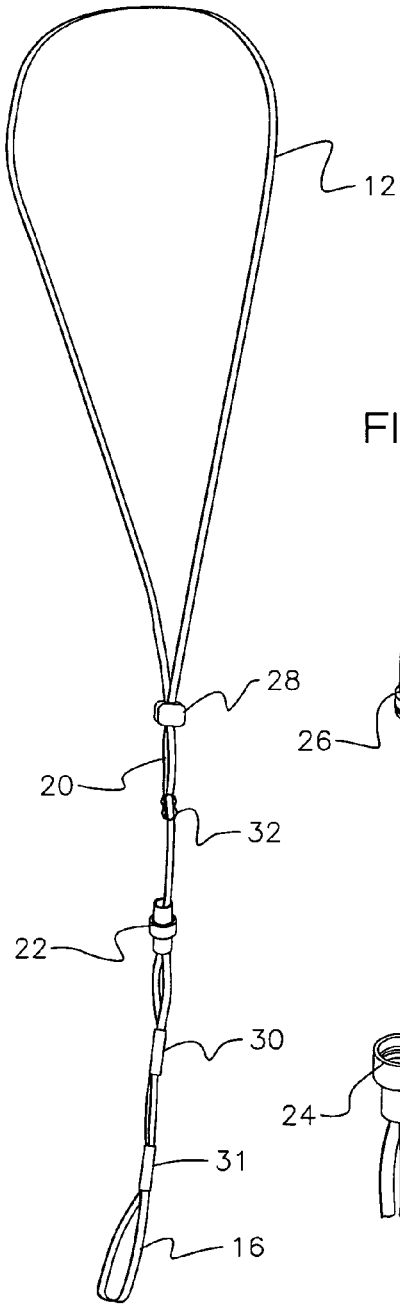
FIG. 4 is a front elevational view of the golf swing training apparatus of this invention.
Figure 6:
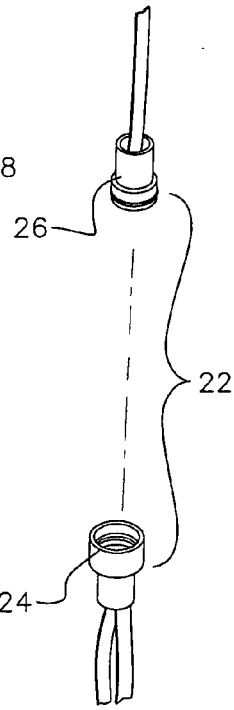
FIG. 6 is an exploded view of the intermediate portion of the golf swing training apparatus showing the disengaged elements.
Figure 5:
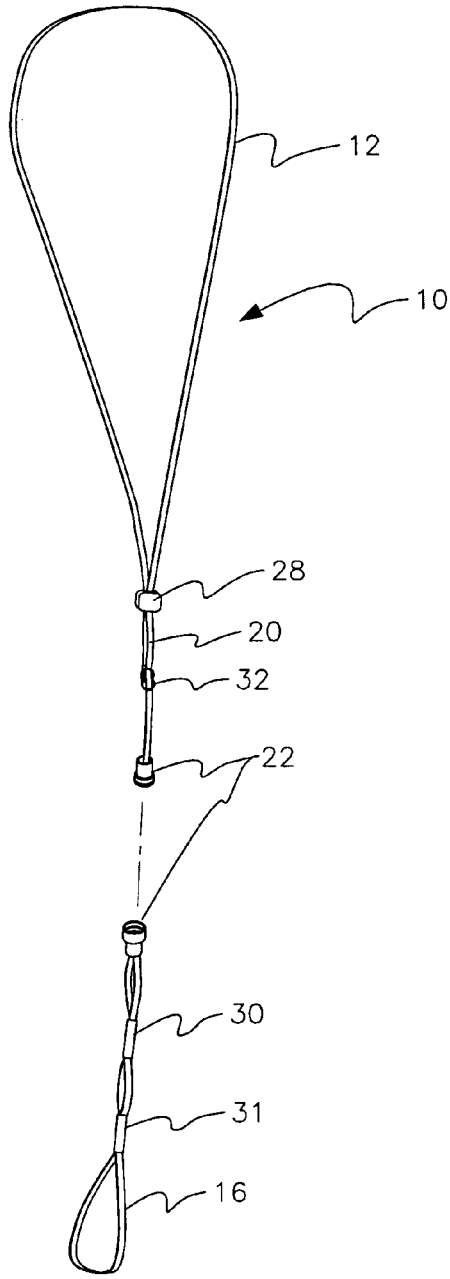
FIG. 5 is a front elevational view of the golf swing training apparatus in a disengaged mode.

The intermediate portion 20 contains the breakaway section 22. Cup 24 receives a plunger 26 in a friction fit at a tension of 7 to 14 ounces per square inch. The preferred pull out strength is about 10 ounces per square inch. As seen in FIGS. 4–6, the top loop 12 can be adjusted in size by moving slider 28. Slider 28 is generally in the collar area when the golfer starts his swing. Three bottom loops 16 are formed by crimps 30 and 31 so that a top intermediate or lower loop can be employed depending on the torso size of the golfer. Although a belt is the preferred attachment point for a bottom loop 16, a waist band, a clip attached to clothing or VELCRO® straps can hold the lower loop 16 in place. A clip 32 in the intermediate portion 20 adjusts the length of the combined upper loop, intermediate portion and lower loops so that it provides a straight profile under slight tension as the golfer addresses the ball, as shown in FIG. 1. If the golfer 14 lifts his head in the downswing mode, the breakaway section 22 will disengage, thus indicating the resulting swing will be defective, and one can expect an errant golf ball shot. Other awkward movements during the downward swing or at contact with the ball will also result in disengagement of the breakaway section 22.

The training apparatus of this invention can be made of cloth, such as cotton, nylon or other like material. It also can be made of leather or other natural materials. The sliders 28 and 30 can be made of metal or plastic, and the clip 32 also can be made of metal or plastic. The breakaway section 22 will generally be made of plastic.

Other equivalent elements can be substituted for the elements disclosed herein to produce the same results in the same way.

What is claimed is:

1. A training device for correcting the swing of a golfer comprising:

(a) a top loop adapted to be worn around a neck of the golfer connected by an intermediate portion to a means adapted for attachment to a mid-section of the golfer;

(b) a means in the intermediate portion for disengaging the top loop from the mid-section of the golfer; and (c) a means for adjusting the length of the combined top loop, intermediate portion and means for attachment to the mid-section of the golfer so there is a straight line connection between the top loop, the intermediate portion, and the mid-section of the golfer when the golfer is addressing a golf ball wherein if the golfer makes a proper swing the means for disengaging the top loop from the mid-section of the golfer does not disengage until the golf swing is in a follow through mode.

2. The training device according to claim 1, wherein the means for attachment to the mid-section of the golfer is a bottom loop around a belt.

3. The training device according to claim 2, wherein the top loop, intermediate portion and bottom loop are made from a cloth material.

4. The training device according to claim 3, wherein the cloth material is a synthetic fiber.

5. The training device according to claim 2, wherein the top loop intermediate portion and bottom loop are made from leather.

6. The training device according to claim 2, wherein the means in the intermediate portion for disengaging the top loop from the bottom loop is a plunger friction fitted into a cup.

7. The training device according to claim 6, wherein the pull out strength of the plunger from the cup is 7 to 14 ounces per square inch.

8. The training device according to claim 2, wherein the means for adjusting the length of the top loop, the intermediate portion, and the bottom loop is an adjustment slider.

9. A method for correcting the swing of a golfer comprising:

(a) providing a top loop around the neck of the golfer, the top loop connected to an intermediate portion;

(b) providing a bottom loop around a mid-section of the golfer, the bottom loop connected to the intermediate portion;

(c) tightening the top and bottom loop and shortening or lengthening the intermediate portion so there is a straight line connection between the neck and belt of the golfer; and (d) providing a disengagement portion in the intermediate portion which disengages when the swing of the golfer is improper, but does not disengage until a follow through swing mode is achieved when the swing of the golfer is in proper form.

10. The method for correcting the swing of a golfer according to claim 9, wherein the disengagement portion is provided as a cup in which a plunger is friction fitted.

11. The method for correcting the swing of a golfer according to claim 10, wherein the plunger pulls out at a tension of 7 to 14 ounces per square inch.

12. The method for correcting the swing of a golfer according to claim 11 wherein the plunger pulls out at a tension of about 10 ounces per square inch.

13. The method for correcting the swing of a golfer according to claim 9 wherein the bottom loop is held on the mid-section of the golfer by a belt.

14. A training device for correcting the swing of a golfer comprising:

(a) a top loop adapted to be worn around a neck of the golfer connected by an intermediate portion to a bottom loop adapted to be worn around a belt of the golfer;

(b) a disengagement device in the intermediate portion for disengaging the top loop from the bottom loop; and (c) an adjustment device for lengthening or shortening the combined top loop, intermediate portion and bottom loop so there is a straight line connection between the top loop, the intermediate portion, and the bottom loop when the golfer is addressing a golf ball, whereupon if the golfer makes a proper swing the disengagement device does not disengage the top loop from the bottom loop until the golf swing is in a follow though mode.

15. The training device according to claim 14 wherein the disengagement device is a plunger friction fitted into a cup.

16. The training device according to claim 15 wherein the pull out strength of the plunger from the cup is 7 to 14 ounces per square inch.

17. The training device according to claim 16 wherein the pull out strength of the plunger from the cup is about 10 ounces per square inch.

18. The training device according to claim 14 wherein the adjustment device is a slider.

19. The training device according to claim 14 wherein there are three bottom loops.

20. The training device according to claim 14 wherein the top loop, intermediate portion and bottom loop are made from cloth lace.

* * * * *